US011740586B2

(12) United States Patent
Watanabe

(10) Patent No.: US 11,740,586 B2
(45) Date of Patent: Aug. 29, 2023

(54) IMAGE FORMING APPARATUS

(71) Applicant: CANON KABUSHIKI KAISHA, Tokyo (JP)

(72) Inventor: Tatsuhito Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/735,848

(22) Filed: May 3, 2022

(65) Prior Publication Data

US 2022/0365481 A1 Nov. 17, 2022

(30) Foreign Application Priority Data

May 13, 2021 (JP) ..... 2021-081507

(51) Int. Cl.
*G03G 21/20* (2006.01)
*G03G 15/00* (2006.01)

(52) U.S. Cl.
CPC ..... *G03G 21/206* (2013.01); *G03G 15/5045* (2013.01); *G03G 2215/00084* (2013.01)

(58) Field of Classification Search
CPC .. G03G 21/206; G03G 15/2017; G03G 21/20; G03G 21/0052; G03G 21/1619; G03G 21/1633
See application file for complete search history.

(56) References Cited

U.S. PATENT DOCUMENTS 6,628,906 B2 9/2003 Kimizuka ..... 399/44
10,990,059 B2 4/2021 Kawasumi et al. ..... G03G 21/1619
2014/0105621 A1* 4/2014 Imanaka ..... G03G 15/0266 399/92
2015/0063858 A1* 3/2015 Nakamura ..... G03G 21/206 399/94
2021/0063945 A1 3/2021 Kawasumi et al. ..... G03G 21/1633
2021/0063946 A1 3/2021 Watanabe et al. ..... G03G 21/1619

FOREIGN PATENT DOCUMENTS

JP 2002-148875 5/2002
JP 2004-347701 12/2004

OTHER PUBLICATIONS

U.S. Appl. No. 17/729,444, filed Apr. 26, 2022.

* cited by examiner

*Primary Examiner* — Jessica L Eley
(74) *Attorney, Agent, or Firm* — Venable LLP

(57) ABSTRACT

An image forming apparatus includes an image forming unit, a fixing unit, a plurality of exterior covers forming an exterior of the image forming apparatus, a fan configured to suck outside air into the image forming apparatus through an air intake port, a temperature sensor configured to detect a temperature of the outside air sucked by the fan, and a partition member disposed upstream the temperature sensor and downstream the air intake port in an airflow generated by the fan, the partition member dividing an air intake path through which the outside air sucked through the air intake port passes into a first path passing through a fixing unit side and a second path passing through a temperature sensor side.

8 Claims, 12 Drawing Sheets

IMAGE FORMING APPARATUS

BACKGROUND OF THE INVENTION

Field of the Invention

The present invention relates to an image forming apparatus using an electrophotographic technology, such as a printer, a copier, a facsimile machine, or a multifunction printer.

Description of the Related Art

In an image forming apparatus, since a fixer including a heater applies heat in order to fix a toner image on a recording material, the fixer becomes a heat source that generates heat, so that a temperature in the apparatus rises. In a case where an image forming operation is continuously performed without suppressing such a temperature rise in the apparatus, a temperature of a toner rises due to the high temperature in the apparatus, which causes a recording material conveyance failure, an image failure, a loading failure, and the like. Therefore, according to the related art, an air intake fan is provided in an image forming apparatus to suppress a temperature rise in the apparatus while cooling the heat source by using sucked outside air (JP 2004-347701 A).

In addition, an apparatus has been proposed in which a temperature of an environment in which an image forming apparatus is installed (which is a temperature outside the image forming apparatus, and is referred to as an outside air temperature) is detected by a temperature sensor, and a temperature of a heater can be adjusted to a fixing temperature optimum for fixing a toner based on the detected outside air temperature (JP 2002-148875 A). In the apparatus described in JP 2002-148875 A, an air intake fan is provided to cause a temperature sensor to detect the outside air temperature by using forced convection, and the temperature sensor is disposed near the air intake fan.

As in the apparatus described in JP 2004-347701 A, the air intake fan that generates an airflow for cooling the heat source is often disposed near the heat source. In addition, in the image forming apparatus, in a case where there is a heat source such as the fixer described above, the temperature in the vicinity of the heat source outside the image forming apparatus tends to be higher than that at a position away from the heat source. Therefore, in a case where the air intake fan that generates an airflow for causing the temperature sensor to detect the air outside the apparatus is also used as a fan for cooling the heat source, there is a possibility that the temperature sensor detects the outside air temperature higher than the temperature of the environment in which the image forming apparatus is installed due to the influence of the heat source.

The present invention provides an image forming apparatus capable of suppressing an outside air temperature of the image forming apparatus detected by a temperature sensor from being affected by a heat source provided in the image forming apparatus.

SUMMARY OF THE INVENTION

According to one aspect of the present invention, an image forming apparatus that forms an image on a recording material, the image forming apparatus includes an image forming unit configured to form a toner image on the recording material, a fixing unit configured to apply heat to the toner image formed on the recording material by the image forming unit to fix the toner image on the recording material, a plurality of exterior covers forming an exterior of the image forming apparatus, a fan configured to suck outside air into the image forming apparatus through an air intake port, a temperature sensor configured to detect a temperature of the outside air sucked by the fan, and a partition member disposed upstream the temperature sensor and downstream the air intake port in an airflow generated by the fan, the partition member dividing an air intake path through which the outside air sucked through the air intake port passes into a first path passing through a fixing unit side and a second path passing through a temperature sensor side.

Further features of the present invention will become apparent from the following description of exemplary embodiments with reference to the attached drawings.

BRIEF DESCRIPTION OF THE DRAWINGS

FIGS. 12A and 12B are graphs illustrating a temperature of a predetermined space and a temperature detected by a temperature sensor, in which FIG. 12A shows a case where there is no partition plate, and FIG. 12B shows a case where there is a partition plate.

DESCRIPTION OF THE EMBODIMENTS

Image Forming Apparatus

Figure 1:
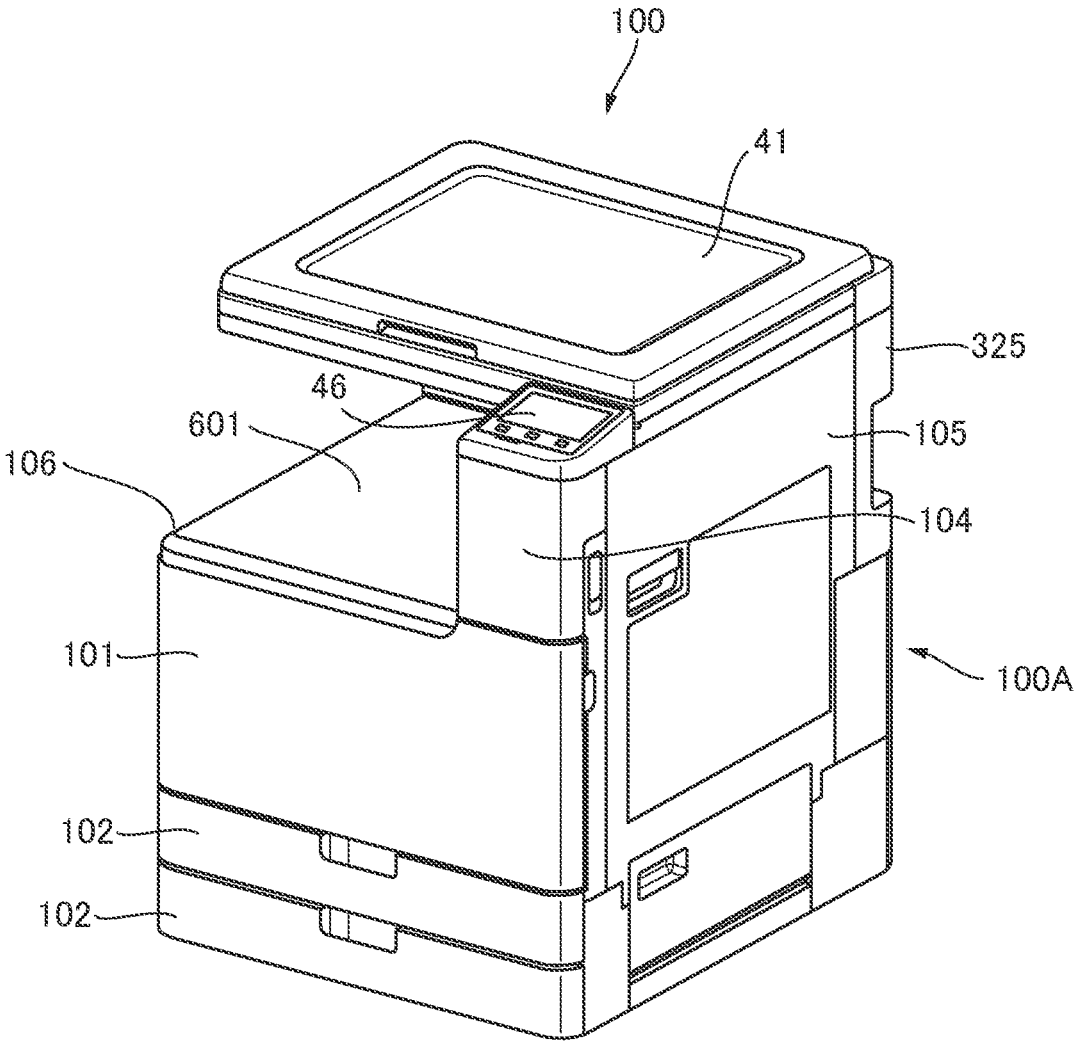
FIG. 1 is an exterior perspective view of an image forming apparatus according to the present embodiment as viewed from the front surface side.

Hereinafter, the present embodiment will be described. First, an outline of an image forming apparatus of the present embodiment will be described with reference to FIGS. 1 and 2. As illustrated in FIG. 1, an image forming apparatus 100 of the present embodiment is a so-called internal sheet discharge type image forming apparatus. That is, the image forming apparatus 100 includes a support frame 100A and a document reading device 41 that reads image information of a document, and a sheet discharge tray 601 on which the recording material S discharged from the support frame 100A is loaded is formed between the support frame 100A and the document reading device 41. An operation unit 46 including a display unit capable of displaying various types of information, a key capable of inputting various types of information according to a user operation, and the like is disposed on a front surface side of the support frame 100A, and an electrical unit (not illustrated) including a power supply board and the like are disposed on a back surface side of the support frame 100A. Note that, in the present specification, a side on which the user stands when operating the operation unit 46 to operate the image forming apparatus 100 is referred to as a "front surface", and a side opposite to the front surface is referred to as a "back surface". Further, a region closer to the front surface than the center in a front-back direction of the image forming apparatus 100 is referred to as a "front surface side", and a region closer to the back surface than the center in the front-back direction of the image forming apparatus 100 is referred to as a "back surface side".

Although not illustrated, the support frame 100A includes a front side plate provided on the front surface side of the image forming apparatus 100, a back side plate provided on the back surface side and supporting each unit together with the front side plate, a stay connecting the front side plate and the back side plate, a plurality of sheet metals such as a support column supporting the front side plate, and the like, and is covered by an exterior cover constituting an appearance of the image forming apparatus 100. As the exterior cover, a front cover 101, a plurality of cassette covers 102, and a front upper cover 104 are disposed on the front surface side. As illustrated, in a vertical direction, the front cover 101 is disposed above the cassette cover 102, and the front upper cover 104 is disposed above the front cover 101. Further, side surface covers 105 and 106 are disposed on left and right side surface sides, respectively, and a back cover 325 is disposed on the back surface side.

Figure 2:
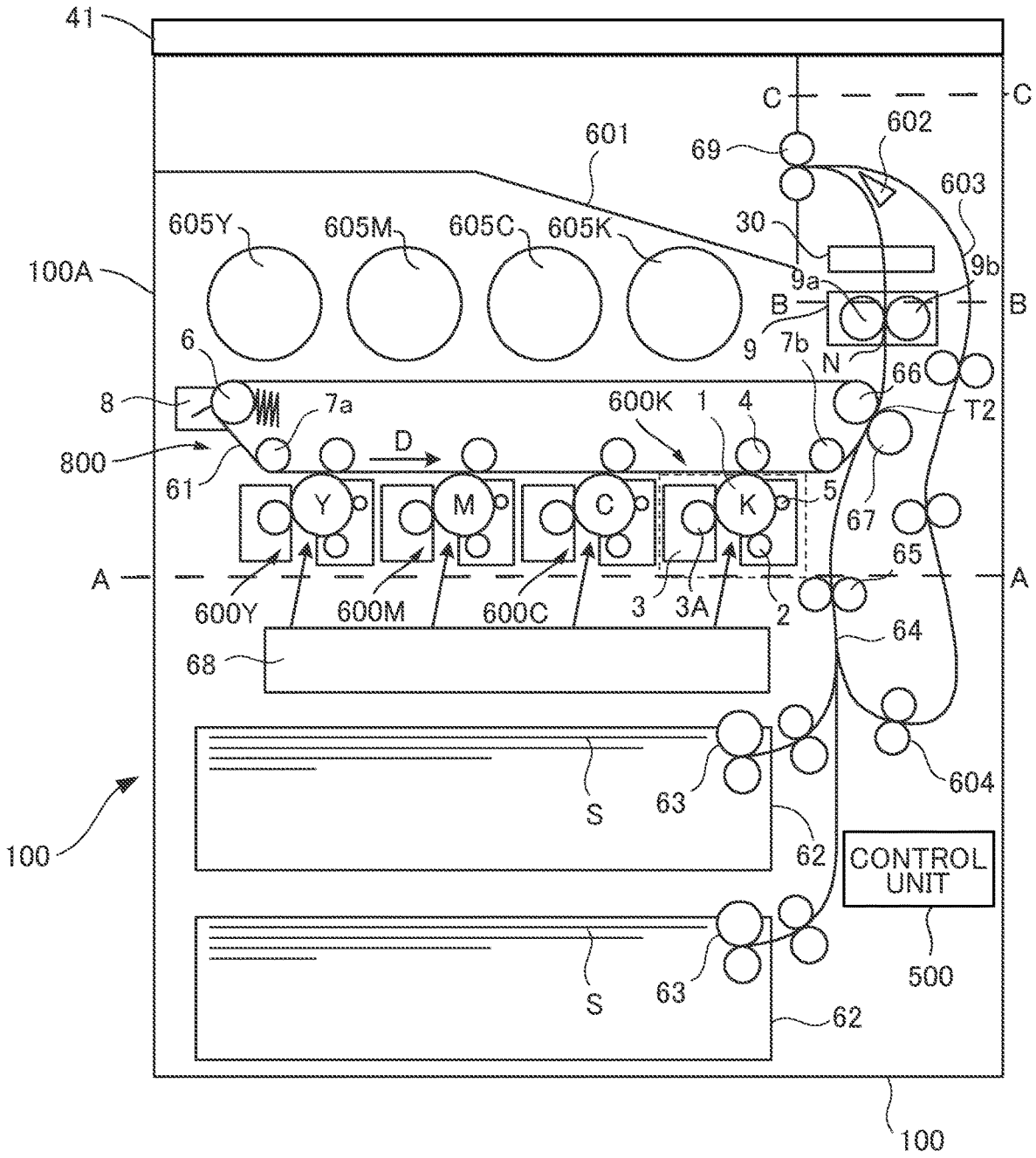
FIG. 2 is a schematic view illustrating a configuration of the image forming apparatus.

As illustrated in FIG. 2, the image forming apparatus 100 of the present embodiment is a so-called intermediate transfer type full-color printer in which image forming units 600Y, 600M, 600C, and 600K of four colors are arranged to face an intermediate transfer belt 61. The image forming apparatus 100 includes the image forming units 600Y, 600M, 600C, and 600K that form toner images of yellow, magenta, cyan, and black, respectively. The image forming apparatus 100 forms a toner image on the recording material S according to an image signal from the document reading device 41 provided above the support frame 100A or an external device (not illustrated) such as a personal computer. Examples of the recording material S include sheet materials such as paper, a plastic film, and cloth.

A recording material conveyance process of the image forming apparatus 100 will be described. The recording materials S are stored in a form of being loaded in one or more (here, two) sheet cassettes 62, and are supplied one by one by a supply roller 63 in accordance with an image forming timing. The recording material S supplied by the supply roller 63 is conveyed to a registration roller 65 disposed in the middle of a conveyance path 64. Then, skew correction and timing correction for the recording material S are performed in the registration roller 65, and the recording material S is conveyed to a secondary transfer portion T2. The secondary transfer portion T2 is formed by an inner secondary transfer roller 66 and an outer secondary transfer roller 67 facing each other with the intermediate transfer belt 61 interposed therebetween, and is a nip portion that transfers the toner image from the intermediate transfer belt 61 onto the recording material S by applying a predetermined pressure and a secondary transfer bias.

A process of forming an image sent to the secondary transfer portion T2 at the same timing as that of the process of conveying the recording material S to the secondary transfer portion T2 described above will be described. First, the image forming units 600Y to 600K will be described. However, since the image forming units 600Y to 600K of the respective colors are basically the same except for the color of the toner, the image forming unit 600K of black will be described below as an example. In FIG. 2, only the image forming unit 600K of black is denoted by a reference sign, and the image forming units of other colors are not denoted by reference signs.

The image forming unit 600K mainly includes a photosensitive drum 1, a charging device 2, a developing device 3, a photosensitive drum cleaner 5, and the like. A surface of the rotationally driven photosensitive drum 1 is uniformly charged in advance by the charging device 2, and then an electrostatic latent image is formed by an exposing device 68 driven based on a signal of image information. Next, the electrostatic latent image formed on the photosensitive drum 1 is visualized through toner development by the developing device 3. The developing device 3 develops the electrostatic latent image with a toner contained in a developer to form a toner image on the photosensitive drum 1.

Thereafter, a predetermined pressure and an electrostatic load bias are applied by a primary transfer roller 4 disposed to face the image forming unit 600K with the intermediate transfer belt 61 interposed therebetween, and the toner image formed on the photosensitive drum 1 is primarily transferred to the intermediate transfer belt 61. A residual primary transfer toner remaining on the photosensitive drum 1 after the primary transfer is collected by the photosensitive drum cleaner 5.

In the present embodiment, four sets of image forming units 600Y to 600K of yellow (Y), magenta (M), cyan (C), and black (K) are provided. However, the number of colors is not limited to four, and the arrangement order of colors is not limited thereto. In addition, the developing device 3 uses a two-component developer containing a nonmagnetic toner and a magnetic carrier as the developer. In this case, since the toner is consumed with the development, the toner can be replenished from each of toner bottles 605Y, 605M, 605C, and 605K containing the toner to the developing device 3 of each color.

The developer for replenishment stored in advance in the toner bottles 605Y to 605K is replenished to each developing device 3 by a toner replenishing device (not illustrated).

The intermediate transfer belt 61 to which the toner image is primarily transferred is an endless belt stretched by a tension roller 6, the inner secondary transfer roller 66, and stretching rollers 7*a* and 7*b* and moved in a direction of an arrow Din the drawing. The process of forming images of the respective colors processed in parallel by the image forming units 600Y to 600K of the respective colors described above is performed at a timing at which the toner images of the colors primarily transferred to the intermediate transfer belt 61 upstream in the moving direction are sequentially superimposed. As a result, a full-color toner image is finally formed on the intermediate transfer belt 61 and conveyed to the secondary transfer portion T2.

A residual secondary transfer toner remaining on the intermediate transfer belt 61 after passing through the secondary transfer portion T2 is collected from the intermediate transfer belt 61 by a transfer cleaner device 8. Note that the primary transfer roller 4 (Y, M, C, or K), the intermediate transfer belt 61, the tension roller 6, the inner secondary transfer roller 66, the stretching rollers 7*a* and 7*b*, and the like are integrally provided as an intermediate transfer belt unit 800.

By the conveyance process and the image forming process described above, the timings of the recording material S and the full-color toner image coincide with each other in the secondary transfer portion T2, and secondary transfer in which the toner image is transferred from the intermediate transfer belt 61 to the recording material S is performed. Thereafter, the recording material S is conveyed to the fixing device 9, and the fixing device 9 applies heat and pressure to fix the toner image to the recording material S.

In the present embodiment, the film heating type fixing device 9 is employed. The fixing device 9 includes a fixing film 9*a* heated by a heater disposed on an inner peripheral side, and a pressure roller 9*b* that abuts on the fixing film 9*a* to form a fixing nip portion N, and fixes the toner image on the recording material S by applying heat and pressure to the recording material S passing through the fixing nip portion N.

The recording material S having passed through the fixing device 9 is conveyed to a sheet discharge roller 69 by a conveyance device 30, and is directly discharged onto the sheet discharge tray 601 by the sheet discharge roller 69 (single-sided mode) or conveyed to a duplex conveyance path 603 for double-sided image formation (double-sided mode). Note that the conveyance device 30 is a conveyance unit that includes a pair of rollers (not illustrated) and can convey the recording material S. In the double-sided mode, the recording material S is conveyed until a trailing edge passes through a switching member 602 by forward rotation of the sheet discharge roller 69, and then a leading edge and the trailing edge are reversed by reversely rotating the sheet discharge roller 69, so that the recording material S is conveyed to the duplex conveyance path 603. Thereafter, the recording material S is again conveyed to the conveyance path 64 by a resupply roller 604. The subsequent conveyance and the image forming process for the back side of the recording material S are similar to those in the above-described case, and thus a description thereof is omitted.

Control Unit

Figure 3:
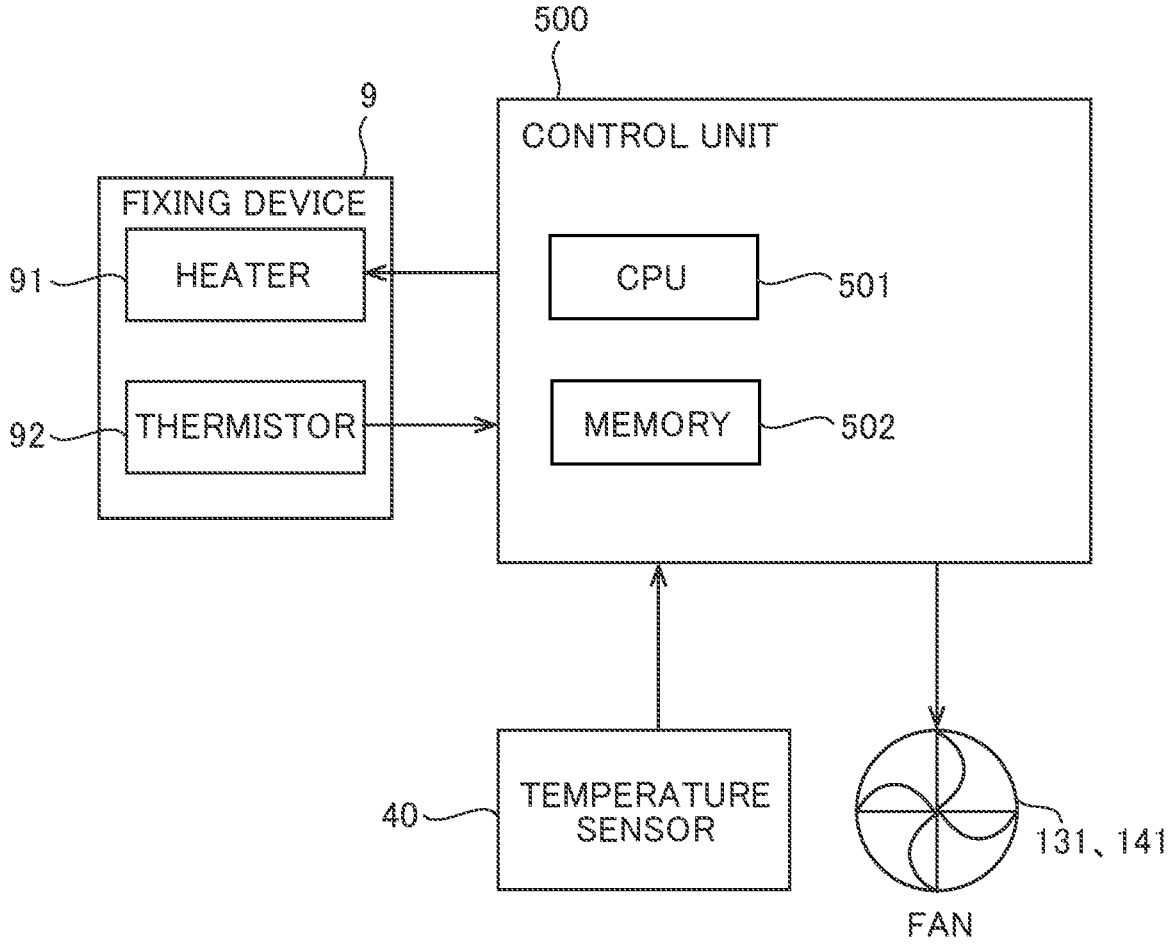
FIG. 3 is a control block diagram illustrating a control unit.

As illustrated in FIG. 2, the image forming apparatus 100 includes a control unit 500. The control unit 500 will be described using FIG. 3 with reference to FIG. 2. However, various devices such as a motor and a power supply for operating the image forming units 600Y to 600K and the intermediate transfer belt unit 800 are connected to the control unit 500 in addition to the illustrated devices, but illustration and description thereof are omitted here because it is not the gist of the invention.

The control unit 500 performs various controls of the image forming apparatus 100 such as an image forming operation, and includes, for example, a central processing unit (CPU) 501 and a memory 502. The memory 502 is implemented by a read only memory (ROM), a random access memory (RAM), or the like. The memory 502 stores various programs and various data for controlling the image forming apparatus 100. The CPU 501 can execute various programs stored in the memory 502, and can operate the image forming apparatus 100 by executing various programs. Note that the memory 502 can also temporarily store calculation processing results and the like accompanying the execution of various programs.

A heater 91, a thermistor 92, and a temperature sensor 40 are connected to the control unit 500 via an input/output interface. The control unit 500 can adjust a temperature of the heater 91 to a temperature appropriate for fixing the toner image by controlling energization of the heater 91 based on a temperature in the vicinity of the fixing nip portion N detected by the thermistor 92 and a temperature detected by the temperature sensor 40. The temperature sensor 40 is a sensor that detects a temperature of an environment in which the image forming apparatus 100 is installed. The control unit 500 adjusts the temperature of the heater 91 every time the temperature detected by the temperature sensor 40 changes by "1° C.", for example.

A first air intake fan 131 and a second air intake fan 141 (see FIGS. 5A and 5B described later) are connected to the control unit 500 via the input/output interface. In the present embodiment, the control unit 500 controls an operation of sucking outside air by the first air intake fan 131 and the second air intake fan 141 based on detection results of the thermistor 92 and the temperature sensor 40 described above.

Incidentally, for example, the developing device 3 is provided with a screw (not illustrated) for circulating and conveying the toner in the developing device 3 storing the toner, and frictional heat is generated in a bearing portion of the screw and the toner with the rotation of the screw, so that a temperature of the developing device 3 rises. However, in a case where the temperature of the developing device 3 rises to a predetermined temperature or higher, the toner may be melted in the developing device 3. In this case, as the toner is electrostatically carried and rotated, the molten toner is also physically attached to a developing sleeve 3A that conveys the toner toward the photosensitive drum 1, which can lead to a coating failure of the developing sleeve 3A. In a case where the coating failure occurs in the developing sleeve 3A, the toner image cannot be appropriately developed on the photosensitive drum 1, and as a result, an image failure occurs in the recording material S. In addition, heat applied for fixing the toner image remains on the recording material S that has passed through the fixing device 9. In a case where there is a large amount of residual heat, the recording material S is curled, and the recording material S is discharged to the sheet discharge tray 601 while the toner has adhesiveness, which causes the loaded recording materials S to adhere to each other due to the toner, which is not preferable.

Therefore, the image forming apparatus 100 of the present embodiment includes an air intake unit that sucks outside air in order to cool the image forming units 600Y to 600K and the conveyance device 30. Hereinafter, an air intake configuration in the image forming apparatus 100 of the present embodiment will be described using FIGS. 4 to 8B with reference to FIGS. 1 and 2.

Figure 4:
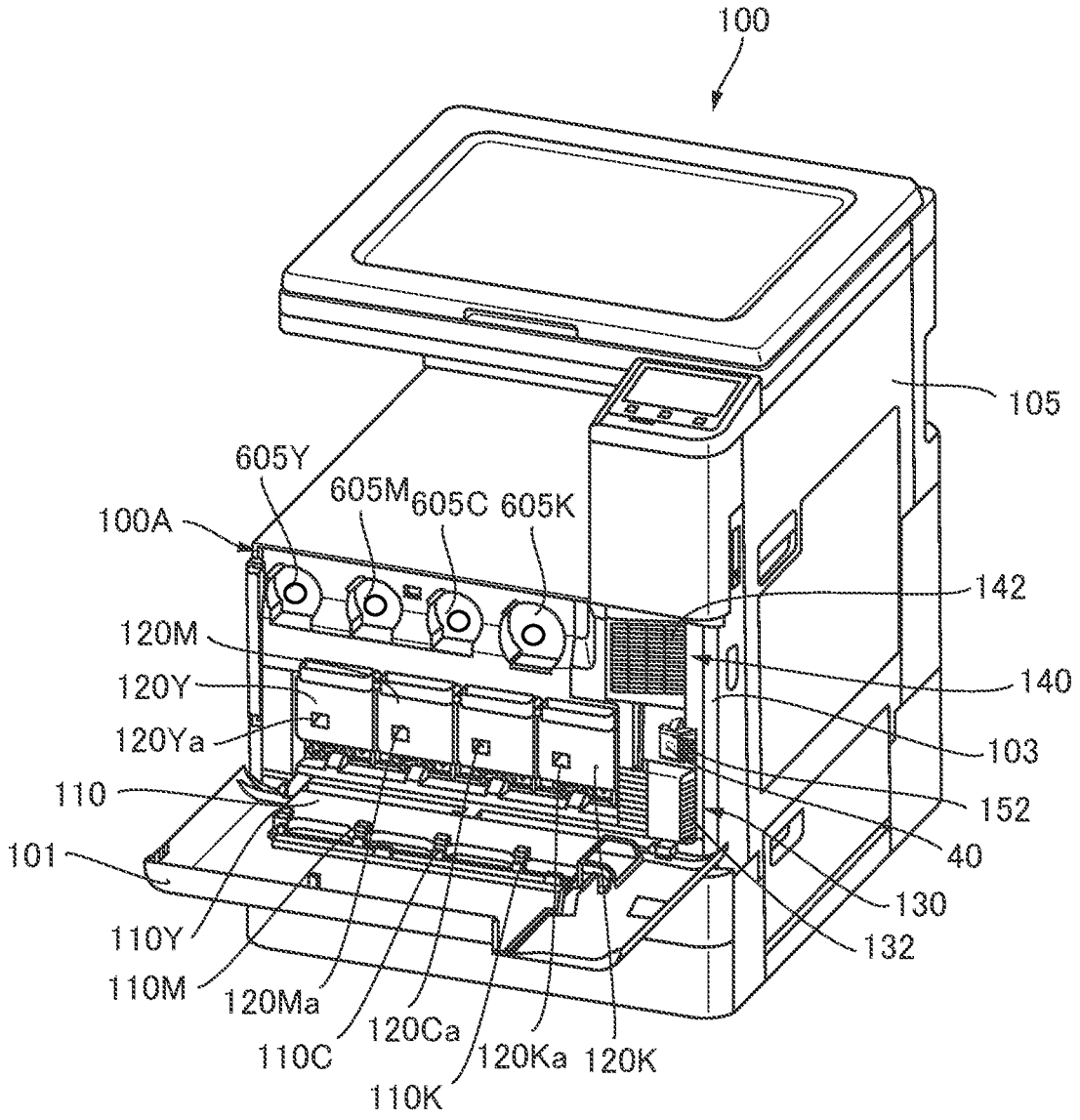
FIG. 4 is a perspective view illustrating the image forming apparatus in a state where a front cover is opened.

The image forming units 600Y to 600K and the toner bottles 605Y to 605K are detachably provided in the image forming apparatus 100 for replacement. In order to enable such a configuration, as illustrated in FIG. 4, the front cover 101 is provided to be openable and closable so as to open the front surface side of the image forming apparatus 100. In the present embodiment, the front cover 101 pivots around a lower side in the vertical direction as a pivot axis. In addition, an inner cover 103 opened to allow insertion and removal of the image forming units 600Y to 600K and the toner bottles 605Y to 605K is fixed to the support frame 100A on an inner side of the apparatus than the front cover 101 is. The inner cover 103 is disposed to face an inner surface of the front cover 101 in a closed state, and separates the front cover 101 from the heat sources such as the fixing device 9 and the image forming units 600Y to 600K. In addition, the side surface cover 105 is provided to be openable and closable in the image forming apparatus 100 in order to remove the recording material S in a case where a conveyance abnormality (a so-called jam) occurs in the conveyance device 30, the duplex conveyance path 603, and the like. The side surface cover 105 in the closed state forms a conveyance path for conveying the recording material S. Note that, in the present embodiment, the pivot axis of the front cover 101 is the lower side in the vertical direction, but the rotation axis may be provided on the left side in a left-right direction (width direction) of the image forming apparatus 100.

Openable front doors 120Y, 120M, 120C, and 120K are disposed in openings of the inner cover 103 through which the image forming units 600Y to 600K are inserted and removed. The front doors 120Y, 120M, 120C, and 120K have through holes 120Ya, 120Ma, 120Ca, and 120Ka through which the sucked outside air passes. Note that, in the present embodiment, unlike the front cover 101, the front upper cover 104 is fixed to the support frame 100A or the like by screws, snap-fits, or the like so as not to be openable and closable.

Air Intake Unit

In the present embodiment, in order to cool the image forming units 600Y to 600K with outside air, a first air intake unit 130 is disposed in the inner cover 103 of the image forming apparatus 100. In order to cool the conveyance device 30, a second air intake unit 140 is disposed in the inner cover 103. As the outside air sucked by these air intake units (130 and 140) passes through the inside of the image forming apparatus 100, not only the heat sources such as the image forming units 600Y to 600K and the conveyance device 30 are cooled, but also a temperature rise in the image forming apparatus 100 due to the heat sources is suppressed. Furthermore, in order to detect the temperature of the environment in which the image forming apparatus 100 is installed (which is referred to as an outside air temperature), the temperature sensor 40 is disposed near the air intake units (130 and 140).

Figure 5A:
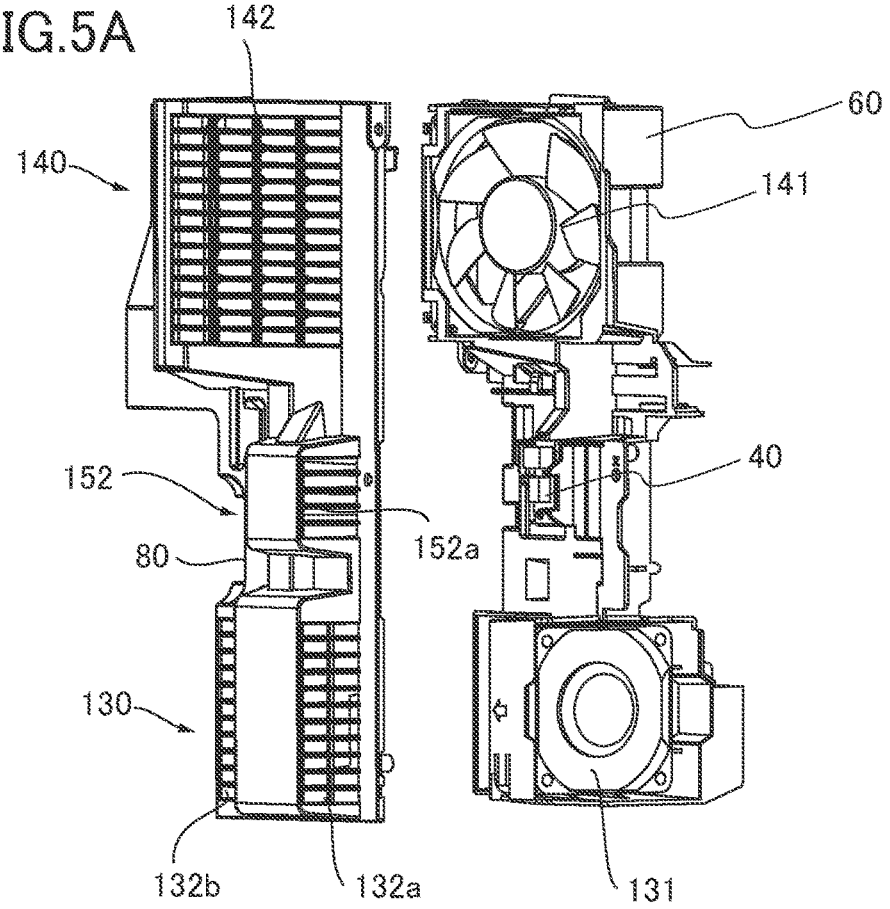
FIG. 5A is an exploded perspective view illustrating an air intake unit.
Figure 5B:
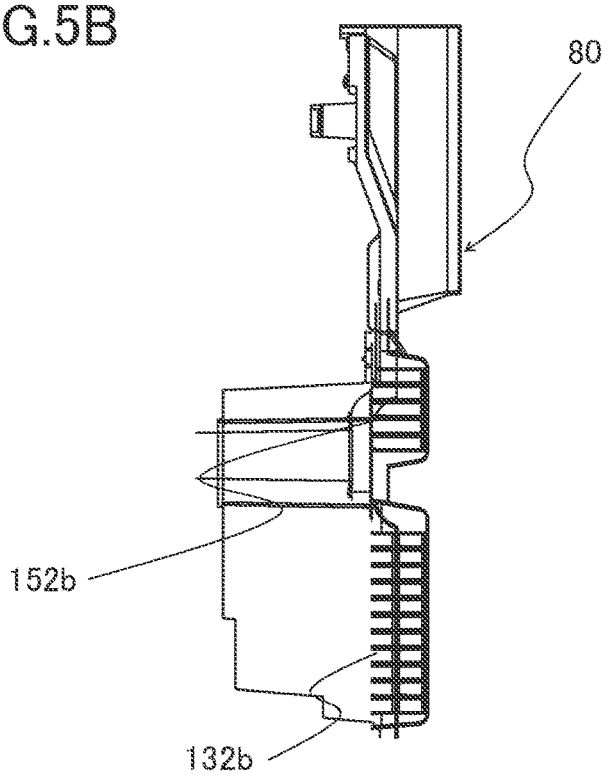
FIG. 5B is a left side view of a cover member.

FIG. 5A is an exploded perspective view of a cover member 80 and a fan holder 60, and FIG. 5B is a left side view of the cover member 80. In the present embodiment, as illustrated in FIG. 5A, the first air intake unit 130, the second air intake unit 140, and the temperature sensor 40 are formed to be disposed at upper and lower positions in the vertical direction in the inner cover 103 at the same time. The first air intake unit 130 includes a first air intake fan 131 and louvers 132*a* and 132*b*, and the second air intake unit 140 includes a second air intake fan 141 and a louver 142. The first air intake fan 131 and the second air intake fan 141 are attached to a fan holder 60, and the louvers 132*a* and 132*b* and the louver 142 are formed in a cover member 80. By attaching the cover member 80 to the fan holder 60, the first air intake fan 131 capable of sucking outside air is disposed on the inner side of the louvers 132*a* and 132*b*, and the second air intake fan 141 capable of sucking outside air is disposed on the inner side of the louver 142. The outside air is sucked by the first air intake fan 131 and the second air intake fan 141, and an airflow flowing into the image forming apparatus 100 via each of the louvers (132*a*, 132*b*, and 142) including a plurality of plate-like members arranged at intervals is formed.

Further, the temperature sensor 40 is fixed to the fan holder 60, and a ventilation guide portion 152 is formed in the cover member 80 in order to guide a part of the sucked outside air toward the temperature sensor 40. The ventilation guide portion 152 includes louvers 152*a* and 152*b*, and the temperature sensor 40 is provided on a path of an airflow sucked into the ventilation guide portion 152 from the louver 152*a* and exhausted to the outside of the ventilation guide portion 152 from the louver 152*b*. In the present embodiment, the temperature sensor 40 is disposed near the second air intake fan 141, and can detect the temperature of the outside air sucked into the image forming apparatus 100 by the second air intake fan 141 as described later. In the present embodiment, the second air intake fan 141 is provided downstream an environment sensor 40 in the airflow formed by the second air intake fan itself.

Returning to FIG. 4, a communication port is formed at an arrangement position of the louver 142 in the inner cover 103, and the outside air sucked by the second air intake fan 141 is guided to the communication port by the louver 142 and flows into the image forming apparatus 100 through the communication port. That is, the louver 142 serving as a ventilation change portion is disposed at the communication port of the inner cover 103, and mainly changes a ventilation direction of a part of the outside air sucked by the second air intake fan 141 toward the conveyance device 30 (heat source) in the image forming apparatus 100. Accordingly, the conveyance device 30 is cooled by the outside air sucked by the second air intake fan 141. Thereafter, the outside air is exhausted from the back surface side of the image forming apparatus 100.

The second air intake fan 141 may be configured to suck air outside the image forming apparatus 100 to generate an airflow for cooling the toner bottles 605Y to 605K. For example, by forming an airflow from the toner bottle 605K toward the toner bottle 605Y in an arrangement direction of the toner bottle 605K (a width direction of the image forming apparatus 100), the toner bottles 605Y to 605K can be cooled by outside air.

On the other hand, in order to cool the image forming units 600Y to 600K with outside air, in addition to the first air intake unit 130, an inner duct 110 is provided on an inner side of the front cover 101 (a side opposite to an exterior surface), and cooling ducts 150Y, 150M, 150C, and 150K (see FIG. 6) are provided in the support frame 100A. The cooling ducts 150Y to 150K serving as first ducts extend in a longitudinal direction of the image forming units 600Y to 600K below the image forming units 600Y to 600K in the vertical direction. The inner duct 110 serving as a second duct extends in an arrangement direction of the image forming units 600Y to 600K (the width direction which is the left-right direction of the image forming apparatus 100).

Figure 6:
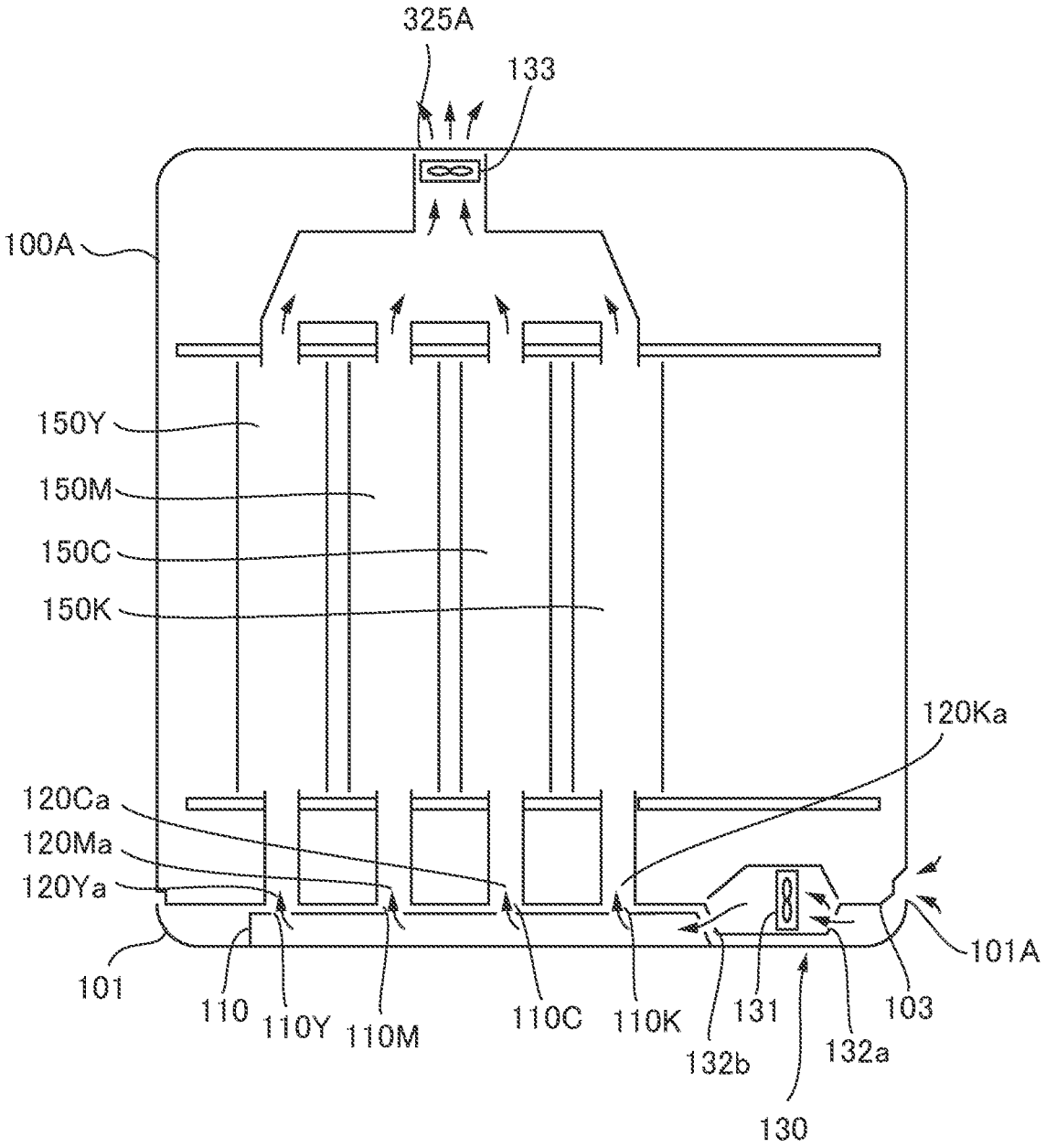
FIG. 6 is a cross-sectional view taken along line A-A in FIG. 2.

As illustrated in FIG. 6, the outside air sucked through the louver 132*a* by the first air intake fan 131 passes through the louver 132*b* and is guided to the inner duct 110. That is, the louvers 132*a* and 132*b* mainly guide a part of the outside air sucked by the first air intake fan 131 to the inner duct 110. The inner duct 110 has opening portions 110Y, 110M, 110C, and 110K corresponding to the four cooling ducts 150Y to 150K. These opening portions 110Y to 110K are formed at positions corresponding to the through holes 120Ya, 120Ma, 120Ca, and 120Ka of the front doors 120Y to 120K. Therefore, the outside air guided to the inner duct 110 by the louvers 132*a* and 132*b* flows into the respective cooling ducts 150Y to 150K through the opening portions 110Y to 110K and the through holes 120Ya to 120Ka. In this manner, the image forming units 600Y to 600K are cooled by the outside air passing through the cooling ducts 150Y to 150K. Thereafter, the outside air is exhausted from the back surface side of the image forming apparatus 100.

In the present embodiment, an airflow that is sucked through an air intake port 101A to be described later and exhausted through an air exhaust port 325A formed on the back surface side is formed by the air intake fans (131 and 141). As illustrated in FIG. 6, it is preferable that an air exhaust fan 133 for air exhaust is disposed in front of the air exhaust port 325A. In a case where the air exhaust fan 133 is provided, cooling using outside air can be efficiently performed.

The reason why the air intake port for sucking the outside air is formed on the front surface side or the side surface side is that it is more suitable than a case where the air intake port is formed on the back surface side in consideration of an installation condition of the image forming apparatus 100. That is, in consideration of user operability of the operation unit 46, the image forming apparatus 100 is installed in a state where the back surface faces a wall surface or the like of an installation place. In such a case, if the air intake port is formed on the back surface side, suction of air by the air intake fans (131 and 141) is easily hindered by the wall surface. In order to avoid such a problem, the air intake port is preferably formed on the front surface side or one side surface side. On the other hand, the reason why the air exhaust port is formed on the back surface side is that in a case where a temperature of the exhausted outside air becomes high and the air exhaust port is formed on the front surface side, high-temperature outside air is blown to the user who operates the operation unit 46, which makes the user uncomfortable. Therefore, the air exhaust port is formed on the back surface side. Note that in a case where the air intake port is formed on the side surface side, it is preferable to form the air intake port on the front surface side as much as possible in accordance with the formation of the air exhaust port on the back surface side in order to generate an airflow appropriate for cooling the inside of the support frame 100A.

Incidentally, generally, a so-called louver in which a plurality of plate-like members are arranged at intervals is provided in the air intake port in many cases, which has an advantage that the area of the air intake port can be increased. However, according to the related art, the air intake port including such a louver is formed on the front surface side which is easily visually recognized by the user, and the appearance quality of the image forming apparatus is thus deteriorated. In addition, under the condition that an outside air temperature and humidity rapidly change, the outside air having a temperature and humidity relatively higher than those in the image forming apparatus tends to quickly flow into the apparatus through the air intake port having a large area, and thus there is a possibility that dew condensation occurs in the apparatus. Furthermore, an operating sound of, for example, a motor or the like provided in the apparatus leaks out from the air intake port, and the operating sound is unpleasant to the user.

Air Intake Port

Figure 7:
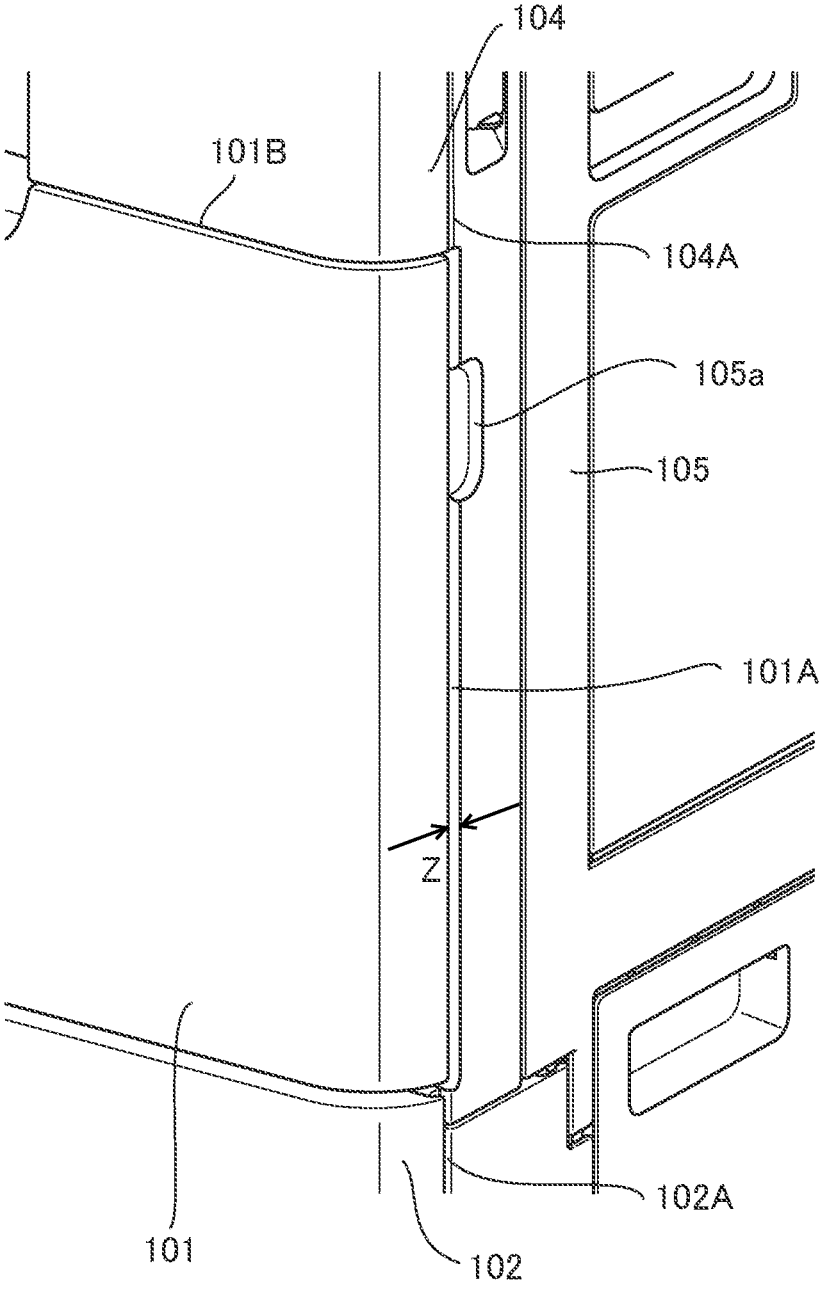
FIG. 7 is a partially enlarged view illustrating an air intake port of the image forming apparatus.

Therefore, as illustrated in FIG. 7, a first gap extending in the vertical direction is formed between the front cover 101 and the side surface cover 105 in a state where the front cover 101 is closed. In the present embodiment, the first gap serves as the air intake port 101A.

In other words, the air intake port 101A is formed by generating a gap between the front cover 101 serving as a first exterior cover and the side surface cover 105 serving as a second exterior cover.

The side surface cover 105 has a recess 105*a* formed to be recessed toward the inside of the apparatus with respect to the exterior surface. The recess 105*a* is provided in a region where the air intake port 101A is provided in the vertical direction. Therefore, in a case where the user or a service engineer opens the front cover 101, fingers are easily hooked from the recess 105*a* to an end portion of the front cover 101, so that the user operability can be improved while improving the appearance quality. Note that, in the above description, the side surface cover 105 is openable and closable with respect to the support frame 100A. However, as long as the recording material on the conveyance path can be removed in a case where a conveyance abnormality occurs, a portion of the side surface cover 105 where a unit constituting the conveyance path is provided may be openable and closable with respect to the support frame 100A, and the other portion may be fixed. For example, as illustrated in FIG. 7, a portion where the recess 105*a* is provided may be fixed to the support frame 100A with a screw or the like.

Further, the air intake port 101A is formed to extend in the vertical direction along the arrangement of the first air intake unit 130 and the second air intake unit 140 so as to serve as both the air intake ports of the first air intake unit 130 and the second air intake unit 140. That is, the air intake port 101A elongated in the vertical direction is formed so that both the first air intake unit 130 and the second air intake unit 140 can sufficiently suck the outside air. That is, the air intake port 101A overlaps both the first air intake unit 130 and the second air intake unit 140 in the vertical direction. The air intake port 101A overlaps both the fan 141 provided in the second air intake unit 140 and the temperature sensor 40 in the vertical direction.

Figure 8A:
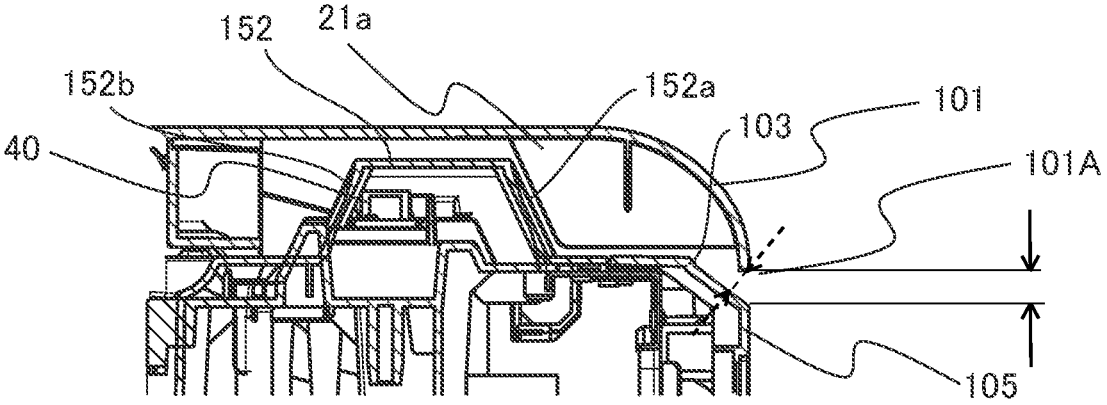
FIG. 8A is a cross-sectional view taken along line B-B in FIG. 2.
Figure 8B:
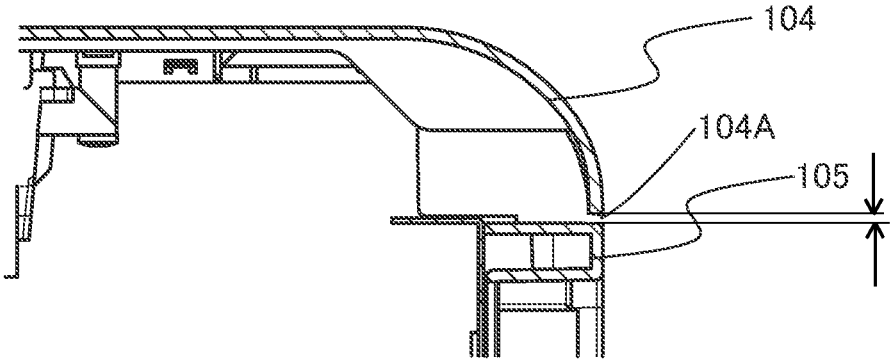
FIG. 8B is a cross-sectional view taken along line C-C in FIG. 2.

As illustrated in FIG. 8A, the air intake port 101A implemented by the first gap communicates with a space formed between the front cover 101 and the inner cover 103 in a state where the front cover 101 is closed, and an air intake path to the ventilation guide portion 152 is secured. That is, air sucked through the air intake port 101A is sucked into the ventilation guide portion 152 through the louver 152*a* and exhausted to the outside of the ventilation guide portion 152 through the louver 152*b*. Further, air intake paths to the louvers 132*a* and 132*b* and the louver 142 are also secured.

In a direction intersecting a first surface provided with the front cover 101, the air intake port 101A is opened wider than a second gap that can be generated between the front upper cover 104 serving as a third exterior cover and the side surface cover 105 serving as the second exterior cover. That is, a gap length of the air intake port 101A, specifically, an interval forming the air intake port 101A between the end portion of the front cover 101 to an end portion of the side surface cover 105, is larger than a gap length of a gap 104A that can be generated between the front upper cover 104 and the side surface cover 105 illustrated in FIG. 8B.

In the present embodiment, a minimum gap length (broken line in FIG. 8A) of the air intake port 101A is 4.8 mm, and a minimum gap length (solid line in FIG. 8B) of the gap 104A is 1 mm. The gap length of the air intake port 101A is larger than that of the gap 104A even in consideration of an assembly tolerance between the front upper cover 104 and the side surface cover 105. Note that, although FIG. 8A is a cross-sectional view of a position where the recess 105*a* is provided, the gap length of the air intake port 101A is larger than the gap length of the gap 104A also at a position above or below the recess 105*a* in the vertical direction. As illustrated in FIGS. 7 and 8A, a surface of the side surface cover 105 that faces the end portion of the front cover 101 is inclined with respect to a surface constituting an appearance of the side surface cover 105. A gap length Z (see FIG. 7) between the surface constituting the appearance of the side surface cover 105 excluding the inclined portion and the end portion of the front cover 101 is 7 mm. As described above, since the gap length of the air intake port 101A is larger than the gap length of the gap 104A between the front upper cover 104 and the side surface cover 105 even in a case where the air intake port 101A has the minimum gap length, the air intake port 101A can act as an air intake port for sucking air into the image forming apparatus 100. Note that, since the gap 104A between the front upper cover 104 and the side surface cover 105 is not an air intake port, the gap length may be 0.

As described above, the first gap (101A) extending in the vertical direction is formed between the front cover 101 and the side surface cover 105 in a state where the front cover 101 is closed. The first gap (101A) communicates with a space formed between the front cover 101 and the inner cover 103 provided to face the inner side of the front cover 101 in a state where the front cover 101 is closed.

In the inner cover 103, the louvers 132*a* and 132*b*, the louver 142, and the ventilation guide portion 152 are provided, and the air intake paths to the respective louvers (132*a*, 132*b*, 142, 152*a*, and 152*b*) are secured along with suction of outside air by the air intake fans (131 and 141). In the configuration in which the outside air is sucked through the first gap as the air intake port 101A, an airflow of the outside air passing through the inside of the apparatus can be secured, and the appearance quality of the apparatus is not deteriorated.

As described above, in the present embodiment, the temperature of the heater 91 is adjusted to a temperature appropriate for fixing the toner image based on the temperature in the vicinity of the fixing nip portion N detected by the thermistor 92 and the temperature detected by the temperature sensor 40. However, the second air intake fan 141 is disposed at a position closer to the fixing device 9 than the first air intake fan 131. Therefore, air sucked by the second air intake fan 141 from the outside of the image forming apparatus 100 is heated by an influence of heat of the fixing device 9, and a temperature of the air may thus be higher than the actual temperature of the environment in which the image forming apparatus 100 is installed. Therefore, the temperature sensor 40 detects the outside air temperature affected by an ambient temperature increased by the heat of the fixing device 9, and thus, there is a possibility that temperature adjustment of the heater 91 described above is not appropriately performed.

Partition Plate

In view of the above, in the present embodiment, the temperature sensor 40 can detect the outside air temperature without being affected by the heat of the fixing device 9. To this end, a partition plate 21*a* is formed on the front cover 101. The partition plate 21*a* will be described with reference to FIGS. 9 to 12B. Note that, in the present specification, a space A refers to a space in the vicinity of a surface of the side surface cover 105 and above the partition plate 21*a*, a space B refers to a space in the vicinity of the surface of the side surface cover 105 and below the partition plate 21*a*, and a space C refers to a space spaced apart from the surface of the side surface cover 105 by "1 m" or more.

Figure 9:
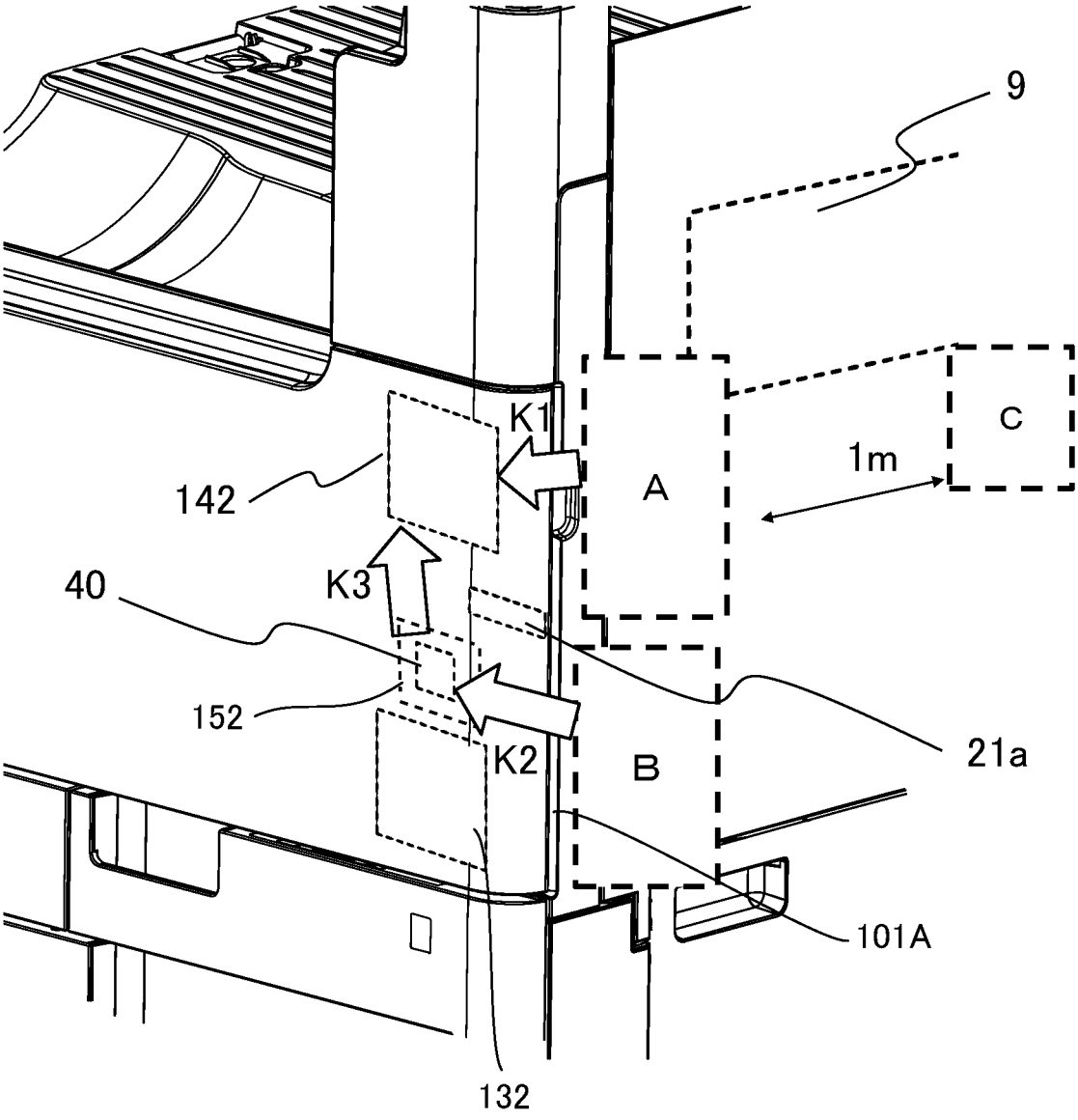
FIG. 9 is a schematic view for describing a partition plate.

As illustrated in FIG. 9, the partition plate 21*a* serving as a partition member is disposed on the inner side of the front cover 101 so as to vertically divide the air intake port 101A extending in the vertical direction. Specifically, the partition plate 21*a* is disposed in such a manner that the outside air sucked through the air intake port 101A by the second air intake fan 141 dividedly flows to a "first path K1" above the partition plate 21*a* and a "second path K2" below the partition plate 21*a*. Accordingly, in association with the operation of the second air intake fan 141, the outside air in the space A mainly passes through the first path K1, and the outside air in the space B mainly passes through the second path K2.

Figure 10:
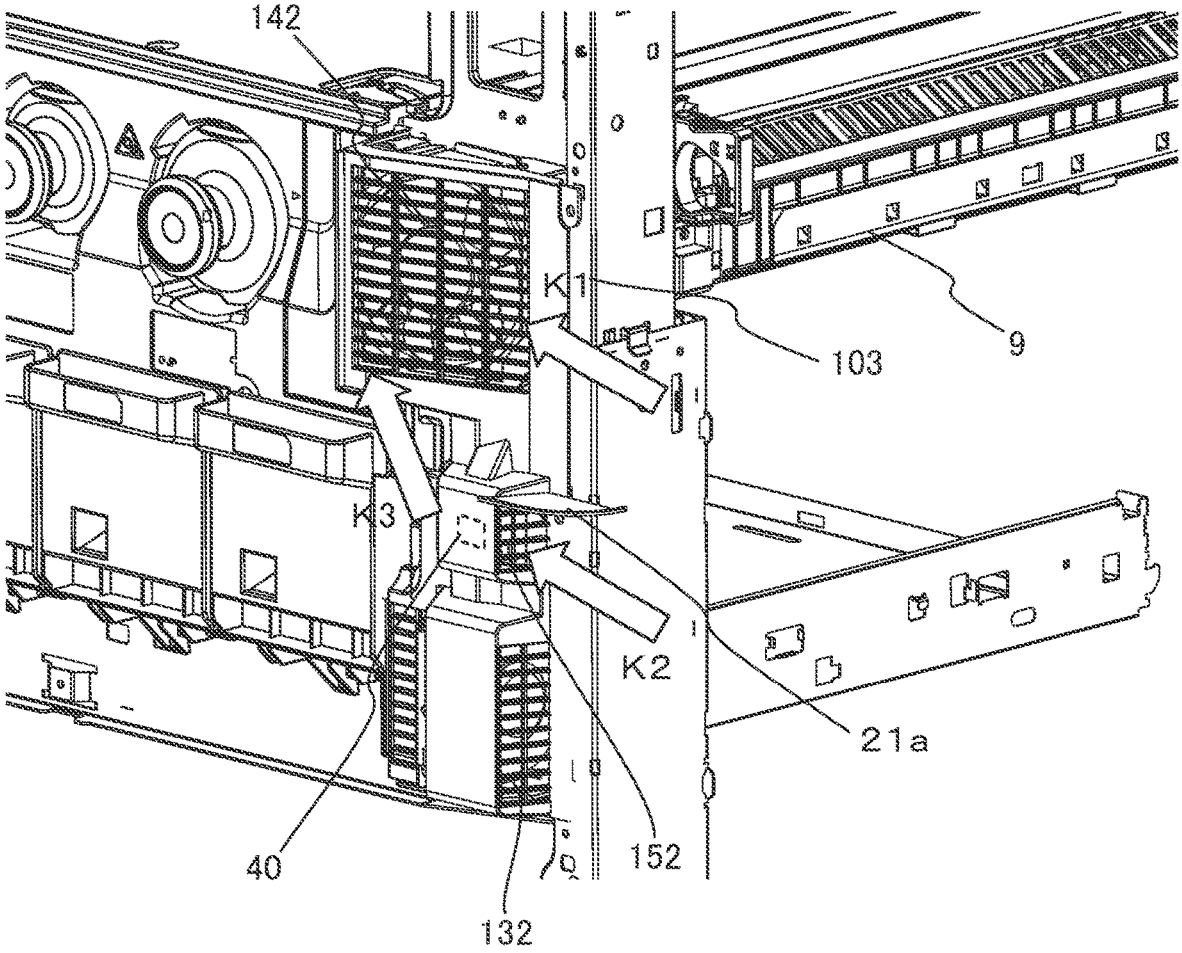
FIG. 10 is a perspective view illustrating the partition plate.

As illustrated in FIG. 10, the partition plate 21*a* is disposed between the fixing device 9 and the temperature sensor 40 so as to shield the ventilation guide portion 152 from the first path K1. The partition plate 21*a* forms the first path K1 leading to the louver 142 in such a manner that the outside air in the space A does not pass through the ventilation guide portion 152, and forms the second path K2 leading to the ventilation guide portion 152 in such a manner that the outside air in the space B is guided to the temperature sensor 40. As described above, the partition plate 21*a* is disposed upstream the temperature sensor 40 and downstream the air intake port 101A in the airflow generated by the second air intake fan 141, and is disposed between the fixing device 9 and the temperature sensor 40 in the vertical direction. Accordingly, the partition plate 21*a* divides an air intake path through which the outside air sucked through the air intake port 101A passes into the first path K1 passing through the fixing device 9 side (heat source side) and the second path K2 passing through the temperature sensor 40 side (temperature sensor side). Note that the outside air in the space B that has passed through the ventilation guide portion 152 is guided toward the louver 142 by the ventilation guide portion 152 (third route K3).

Figure 11:
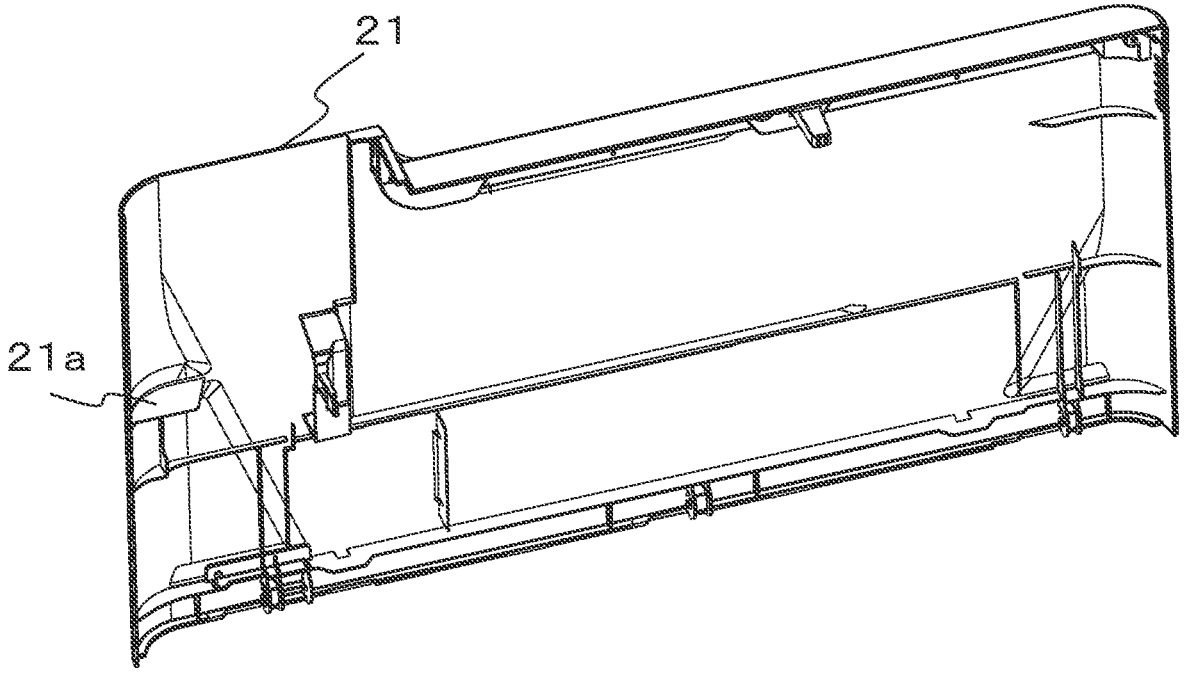
FIG. 11 is a perspective view illustrating the partition plate provided on the front cover.

Note that the partition plate 21*a* may be provided on the inner cover 103. However, in a case where the partition plate 21*a* is provided on the inner cover 103, the partition plate 21*a* remains on the inner cover 103 and is exposed in a state where the front cover 101 is opened. In this case, in a case where the user replaces the image forming units 600Y to 600K and the toner bottles 605Y to 605K (see FIG. 2), the partition plate 21*a* provided on the inner cover 103 may interfere with a replacement work. In order to prevent the interference, the partition plate 21*a* is preferably formed on the inner side of the front cover 21 as illustrated in FIG. 11. In this case, as illustrated in FIG. 8A, the partition plate 21*a* is formed on the front cover 101 in such a manner that a clearance from the inner cover 103 is as small as possible. In this way, the partition plate 21*a* makes it difficult for the outside air in the space A to pass through the ventilation guide portion 152, and the outside air in the space B can easily pass through the ventilation guide portion 152.

Figure 12A:
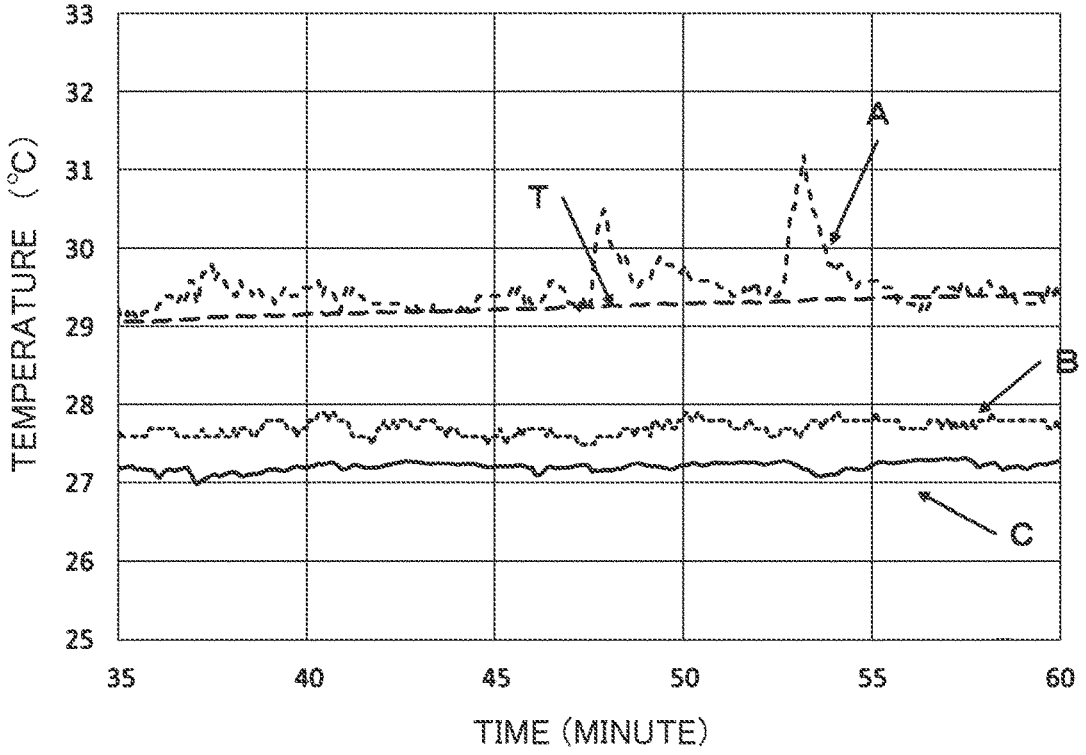
Figure 12B:
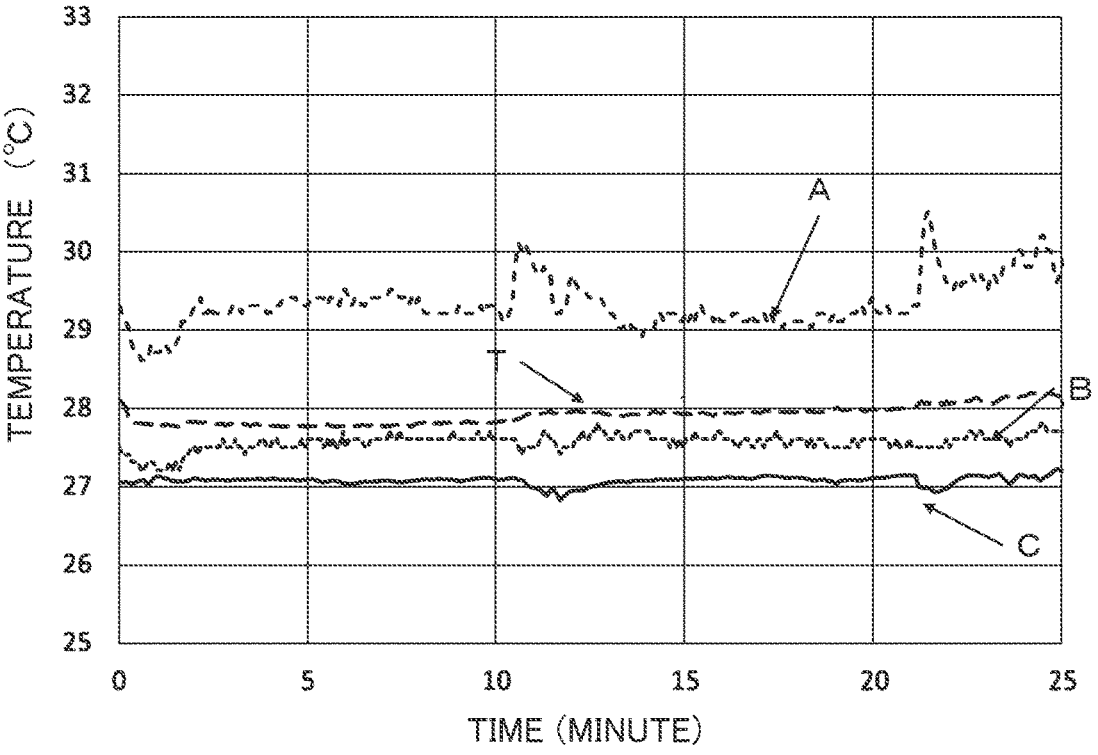

FIG. 12A is a graph illustrating a temperature of each space (A, B, and C) (see FIG. 9) and the temperature detected by the temperature sensor 40 in a comparative example in which the partition plate 21*a* is not provided. FIG. 12B is a graph illustrating a temperature of each space (A, B, and C) and the temperature detected by the temperature sensor 40 in the present embodiment in which the partition plate 21*a* is provided. In FIGS. 12A and 12B, the temperature of the space A, the temperature T detected by the temperature sensor 40, the temperature of the space B, and the temperature of the space C with respect to an elapsed time in a case where the image forming apparatus 100 is continuously operated are illustrated in order from the top.

As illustrated in FIG. 12A, the temperature of the space C is around "27° C.", which is substantially the same as room temperature. The temperature of the space B is around "27.5° C.", and a difference from the temperature of the space C is "1° C." or less. Meanwhile, the temperature of the space A is "29 to 30° C.", which is higher than the temperature of the space C by "2 to 3° C.". This is because the space A is near the fixing device 9, and the outside air in the space A is heated by the heat of the fixing device 9. In a case where the partition plate 21*a* is not provided, the temperature T detected by the temperature sensor 40 is closer to the temperature of the space A than to the temperature of the space C. This is because, in a case where the partition plate

21*a* is not provided, the outside air in the space A sucked through the air intake port 101A by the second air intake fan 141 flows not only to the louver 142 but also to the ventilation guide portion 152, and the temperature sensor 40 is affected by the outside air in the space A having a high temperature.

On the other hand, as illustrated in FIG. 12B, in a case where the partition plate 21*a* is provided, the temperature T detected by the temperature sensor 40 is closer to the temperature of the space B or the temperature of the space C than to the temperature of the space A. As the partition plate 21*a* is provided, a difference between the temperature of the space C and the temperature T detected by the temperature sensor 40 is suppressed to "±1° C." or less. This is because, as described above, the first path K1 leading to the louver 142 is formed by the partition plate 21*a* in such a manner that the outside air in the space A does not pass through the ventilation guide portion 152, and the temperature sensor 40 is hardly affected by the outside air in the space A having a high temperature. Since the difference between the temperature of the space C and the temperature T detected by the temperature sensor 40 is suppressed to "±1° C." or less, the heater 91 of the fixing device 9 can be adjusted to a fixing temperature optimum for fixing the toner according to the temperature of the space C.

As described above, in the present embodiment, the partition plate 21*a* is disposed between the fixing device 9 as a heat source that can increase the temperature of the space A and the temperature sensor 40 that detects the outside air temperature so as to vertically divide the air intake port 101A formed so as to extend in the vertical direction. The partition plate 21*a* forms the first path K1 in such a manner that the outside air in the space A does not pass through the ventilation guide portion 152, and forms the second path K2 leading to the ventilation guide portion 152 in such a manner that the outside air in the space B is guided to the temperature sensor 40.

That is, as the partition plate 21*a* is provided, the outside air in the space A hardly passes through the ventilation guide portion 152, and the outside air in the space B easily passes through the ventilation guide portion 152. Therefore, the temperature sensor 40 can detect the temperature of the outside air in the space B without being affected by the outside air in the space A having a high temperature. As described above, in the present embodiment, with a simple configuration, the influence of the heat source provided in the apparatus on the outside air temperature can be suppressed, so that the temperature sensor 40 can appropriately detect the temperature of the outside air sucked by the air intake fans (131 and 141).

Note that, in the above-described embodiment, an example has been described in which the control unit 500 adjusts the temperature of the heater 91 of the fixing device 9 based on the temperature detected by the temperature sensor 40, but the present invention is not limited thereto. For example, the control unit 500 may adjust a secondary transfer voltage to be applied in a case where the toner image is transferred from the intermediate transfer belt 61 onto the recording material S based on the detection result of the temperature sensor 40.

Further, in the above-described embodiment, the fixing device 9 has been described as an example of the heat source, but the temperature sensor 40 may be disposed on a path of an airflow for cooling a control board as a heat source provided on the back surface side of the image forming apparatus 100. Even in this case, as the partition plate 21*a* described above is provided on the exterior cover that covers the control board, it is possible to suppress the temperature sensor 40 from detecting the outside air temperature affected by the heat of the control board.

Note that, in the above-described embodiment, a case where the temperature sensor 40 and the fixing device 9 controlled based on the outside air temperature detected by the temperature sensor 40 are disposed vertically in the vertical direction has been described as an example, but the present invention is not limited thereto. For example, in a case where the temperature sensor 40 and the fixing device 9 are disposed side by side in the horizontal direction, the partition plate 21*a* may be provided between the temperature sensor 40 and the fixing device 9 in the horizontal direction.

According to the present invention, it is possible to suppress the outside air temperature of the image forming apparatus detected by the temperature sensor from being affected by the heat source provided in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-081507, filed May 13, 2021, which is hereby incorporated by reference herein in its entirety.

What is claimed is:

1. An image forming apparatus that forms an image on a recording material, the image forming apparatus comprising:

an image forming unit configured to form a toner image on the recording material;

a fixing unit configured to apply heat to the toner image formed on the recording material by the image forming unit to fix the toner image on the recording material;

a plurality of exterior covers forming an exterior of the image forming apparatus, the plurality of exterior convers including:

a first exterior cover provided on a front surface of the image forming apparatus so as to be openable and closable;

a second exterior cover provided on a side surface of the image forming apparatus; and a third exterior cover fixed on a front surface side of the image forming apparatus and above the first exterior cover in a vertical direction, a fan configured to suck outside air into the image forming apparatus through a gap as an air intake port formed between the first exterior cover and the second exterior cover, the gap formed between the first exterior cover and the second exterior cover being larger than a gap formed between the third exterior cover and the second exterior cover, in a state where the first exterior cover is closed;

a temperature sensor configured to detect a temperature of the outside air sucked by the fan; and a partition member disposed upstream the temperature sensor and downstream the air intake port in an airflow generated by the fan, the partition member dividing an air intake path through which the outside air sucked through the air intake port passes into a first path passing through a fixing unit side and a second path passing through a temperature sensor side.

2. The image forming apparatus according to claim 1, further comprising an inner cover disposed to face an inner surface of the first exterior cover in a closed state, wherein the gap formed between the first exterior cover and the second exterior cover communicates with a space formed between the first exterior cover and the inner cover in a state where the first exterior cover is closed, and the temperature sensor is disposed in the space formed between the first exterior cover and the inner cover.

3. The image forming apparatus according to claim 2, further comprises:

a ventilation change portion; and a ventilation guide portion, wherein the inner cover has a communication port communicating with a space inside the image forming apparatus, and the ventilation change portion is disposed in the communication port of the inner cover and configured to change a ventilation direction of the outside air passing through the first path toward the fixing unit side, and the ventilation guide portion is configured to guide a ventilation direction of the outside air passing through the second path toward the temperature sensor.

4. The image forming apparatus according to claim 1, wherein the partition member is provided on an inner side of the first exterior cover.

5. The image forming apparatus according to claim 1, wherein an operation unit configured to input various types of information according to a user operation is provided on a front surface of the image forming apparatus.

6. The image forming apparatus according to claim 1, wherein the temperature sensor is provided below the fixing unit in a vertical direction, and the partition member is provided between the fixing unit and the temperature sensor in the vertical direction.

7. The image forming apparatus according to claim 1, wherein the air intake port is provided so as to overlap the fan and the temperature sensor in a vertical direction.

8. The image forming apparatus according to claim 1, wherein the temperature sensor is provided side by side with the fixing unit in a horizontal direction, and the partition member is provided between the fixing unit and the temperature sensor in the horizontal direction.

* * * * *